US010625319B2

(12) United States Patent
Wolf et al.

(10) Patent No.: US 10,625,319 B2
(45) Date of Patent: Apr. 21, 2020

(54) METHOD OF MANUFACTURING A CYLINDRICAL HOUSING OF AN EXHAUST GAS TREATMENT UNIT AND METHOD OF MANUFACTURING AN EXHAUST GAS TREATMENT UNIT FOR VEHICLES

(71) Applicant: Faurecia Emissions Control Technologies, Augsburg (DE)

(72) Inventors: Roland Wolf, Kemnath (DE); Georg Mosonyi, Maisach (DE); Philipp Hug, Neusaess (DE)

(73) Assignee: Faurecia Emissions Control Technologies, Germany GmbH (DE)

( * ) Notice: Subject to any disclaimer, the term of this patent is extended or adjusted under 35 U.S.C. 154(b) by 246 days.

(21) Appl. No.: 15/546,731

(22) PCT Filed: Jan. 29, 2015

(86) PCT No.: PCT/EP2015/051847

§ 371 (c)(1),
(2) Date: Dec. 18, 2017

(87) PCT Pub. No.: WO2016/119865

PCT Pub. Date: Aug. 4, 2016

(65) Prior Publication Data

US 2018/0169728 A1 Jun. 21, 2018

(51) Int. Cl.
*F01N 13/18* (2010.01)
*B21D 51/10* (2006.01)
(Continued)

(52) U.S. Cl.
CPC ..... *B21D 5/146* (2013.01); *B21D 51/10* (2013.01); *B21D 53/00* (2013.01); *F01N 13/18* (2013.01);
(Continued)

(58) Field of Classification Search
CPC . B21D 51/10; F01N 13/1872; F01N 2470/06; F01N 2470/10; F01N 2470/26; F01N 13/18; Y10T 29/49398
See application file for complete search history.

(56) References Cited

U.S. PATENT DOCUMENTS 5,557,847 A 9/1996 Koshiba et al.
2008/0053079 A1* 3/2008 Diringer ..... F01N 13/1844 60/311
(Continued)

FOREIGN PATENT DOCUMENTS

CA 2271015 A1 * 6/1998 ..... B29C 70/34
DE 4437986 A1 4/1996
(Continued)

OTHER PUBLICATIONS

International Search Report from PCT/EP2015/051847.
(Continued)

*Primary Examiner* — Jermie E Cozart
(74) *Attorney, Agent, or Firm* — Carlson, Gaskey & Olds, P.C.

(57) ABSTRACT

A method of manufacturing a cylindrical housing of an exhaust-gas treatment unit for vehicles includes providing a flat sheet metal part having at least one embossing, and round bending the sheet-metal part in a round bending tool by displacing the sheet metal part between rolls such that the sheet metal part obtains a cylindrical shape having a longitudinal direction parallel to roll axes of the rolls. At least one elastic roll is used such that the embossing of the sheet metal part is maintained during round bending. The longitudinal edges of the cylindrical sheet metal part are then connected to form a tube. A method of manufacturing an exhaust-gas treatment unit is furthermore shown.

17 Claims, 3 Drawing Sheets

(51) Int. Cl.
*B21D 5/14* (2006.01)
*B21D 53/00* (2006.01)

(52) U.S. Cl.
CPC ..... *F01N 13/1872* (2013.01); *F01N 2470/06* (2013.01); *F01N 2470/10* (2013.01); *F01N 2470/26* (2013.01); *Y10T 29/49398* (2015.01)

(56) References Cited

U.S. PATENT DOCUMENTS

| | | | | |
|---|---|---|---|---|
| 2008/0066632 | A1* | 3/2008 | Raueiser | B26D 7/2628 101/24 |
| 2013/0202887 | A1 | 8/2013 | Weidner et al. | |

FOREIGN PATENT DOCUMENTS

| | | | | | |
|---|---|---|---|---|---|
| DE | 4445557 | | | 6/1996 | |
| GB | 564598 | A | * | 10/1944 | B21D 22/10 |
| JP | 09310613 | A | * | 12/1997 | |
| JP | 2003206734 | | | 7/2003 | |
| JP | 2010167468 | A | | 8/2010 | |
| KR | 101260743 | B1 | * | 5/2013 | |
| WO | 2014167402 | | | 10/2014 | |

OTHER PUBLICATIONS

English Translation of the International Preliminary Report on Patentability for International Application No. PCT/EP2015/051847 dated Aug. 10, 2017.
Chinese Office Action for Chinese Application No. 201580078471.1 dated Sep. 14, 2018.

* cited by examiner

METHOD OF MANUFACTURING A CYLINDRICAL HOUSING OF AN EXHAUST GAS TREATMENT UNIT AND METHOD OF MANUFACTURING AN EXHAUST GAS TREATMENT UNIT FOR VEHICLES

CROSS-REFERENCE TO RELATED APPLICATIONS

This application is the U.S. national phase of PCT/EP2015/051847 filed Jan. 29, 2015.

FIELD OF THE INVENTION

The invention relates to a method of manufacturing a cylindrical housing of an exhaust-gas treatment unit for vehicles through which exhaust gas flows, and to a method of manufacturing an exhaust-gas treatment unit for vehicles.

BACKGROUND

Various, partially opposite demands are made on housings for exhaust-gas treatment units such as mufflers, catalyst or particulate filters. The demands relating to a high rigidity, acoustics, and appearance of the housing are in contrast to the demands relating to a weight that is as low as possible. Usually, such housings are therefore produced from a thin metal sheet which is provided with ribs or beads. The desired rigidity, acoustics, and appearance of the housing are thus obtained with a low amount of material used. The manufacture of such beaded housings is however complex and cost-intensive since they are usually manufactured in a monocoque design.

The object of the invention is to provide a method of manufacturing a housing of an exhaust-gas treatment unit which is both cost-efficient and provides a lightweight housing having the required rigidity.

SUMMARY

The present invention provides a method of manufacturing a cylindrical housing of an exhaust-gas treatment unit for vehicles through which exhaust gas flows, comprising the steps of:

a) providing a flat sheet metal part having at least one embossing, b) round bending the sheet metal part in a round bending tool by displacing the sheet metal part between rolls such that the sheet metal part obtains a cylindrical shape having a longitudinal direction parallel to roll axes of the rolls, and with at least one elastic roll being used such that the embossing of the sheet metal part is maintained during round bending, and c) connecting longitudinal edges of the cylindrical sheet metal part to form a tube.

An elastic roll here also means that a peripheral wall of the roll is elastically flexible and has an elastic coating, for example. Furthermore, the term "cylindrical shape" means both circular cylinders and those cylinders having an oval, elliptic or any base. In step b), the cylinder need not necessarily be circumferentially closed, but the metal sheet is bent to such an extent that the opposed longitudinal edges can be pressed together without any further plastic reshaping in order to realize step c).

As elastic rolls are used, it is possible to process sheet metal parts to form housings having embossings which in particular stiffen the housing using a cost-effective round bending method. This results in a simple and cost-effective manufacture of stiff and simultaneously lightweight housings for exhaust-gas treatment units.

Preferably, the sheet metal part is cut to size and embossed in the flat state prior to round bending such that the housing is already finished after the connection of the longitudinal edges. This is now possible as the embossings are maintained during round bending. So far, embossings have been incorporated partially after the manufacture of the cylindrical housing using complex tools.

The cutting to size and the embossing can be carried out in one processing step as a result of which the costs for the manufacture of the housing are further reduced.

The cutting to size and the embossing are, for example, carried out in a stamping tool, the cutting to size of the metal sheet and the incorporation of the embossing being carried out in the same stroke as a result of which known and cost-effective production methods can be used.

The embossing preferably produces a rib, a bead, and/or a honeycomb structure. The embossing thus contributes to the stiffening of the housing.

A plurality of embossings is, for example, incorporated into the sheet metal part, with all embossings projecting to the same side of the sheet metal part, and at least one roll of the round bending tool which comes into contact with the projecting side of the embossing being realized in an elastic manner. It is thus ensured that the embossing of the sheet metal part is maintained during round bending.

In one variant embodiment, at least three rolls are used for the round bending, the three rolls including at least one upper roll and one lower roll, and including at least one driven roll The sheet metal is here displaced several times back and forth between the rolls, and at least one upper roll and at least one lower roll are spaced from each other in different manners in the individual displacement steps. It is thus possible in a simple way to manufacture cylindrical housings having circular, elliptic, oval, or other bases.

Preferably, several lower rolls are used which are arranged side by side, i.e. one after the other in the displacement direction of the sheet metal, and parallel to each other, the outer ones of the lower rolls being shifted with respect to each other when the sheet metal part is displaced, as a result of which it is possible to adjust the local bending radius of the housing.

One elastic roll which has a roll core and a coating, in particular a rubber coating is for example used, the coating being fastened, in particular vulcanized onto the roll core, as a result of which the roll has a long service life.

It is possible to use roll cores and/or rolls made of steel when the rolls are not elastic rolls, as a result of which the quality of round bending is improved.

In one variant embodiment, a coating having a thickness of at least 5 mm and/or a maximum Shore hardness of 95 is used, as a result of which it is ensured that the embossing is maintained during round bending.

The thickness of the coating may be at least 125% of the maximum projection of the deepest embossing.

It is possible to use three lower rolls which are configured as elastic rolls, as a result of which a particular accurate round bending result is achieved.

In one configuration of the invention, the housing has a wall thickness of less than 1.25 mm, in particular of 0.8 mm or less such that the housing is particularly light.

The longitudinal edges are preferably connected to each other by welding, in particular by tungsten inert-gas welding (TIG welding) and/or by seaming, as a result of which it is possible to close the housing in a simple and cost-effective manner.

The object is furthermore achieved by a method of manufacturing an exhaust-gas treatment unit for vehicles, in particular mufflers, comprising the following additional steps:

manufacturing a cylindrical housing using the method described above, inserting an insert into the circumferentially closed housing, and fastening covers to the end faces of the housing.

Here, the insert may be a sound-damping insert or a monolith for catalyst or particulate filters. They can be incorporated into the housing by stuffing. This permits a cost-effective manufacture of an exhaust-gas treatment unit for vehicles.

In case of a muffler unit as an exhaust-gas treatment unit, sound-damping material, it is in particular possible to incorporate wool into the housing, as a result of which the sound-damping properties of the muffler are improved.

DETAILED DESCRIPTION

Figure 1A:
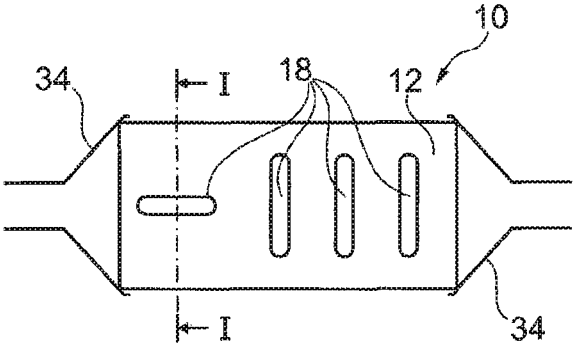
FIGS. 1*a* and 1*b* schematically show two exhaust-gas treatment units manufactured according to the invention in a lateral view, FIG. 1*c* schematically shows the exhaust-gas treatment unit of FIGS. 1*a*, 1*b* in a section along the axis I-I, FIG. 2*a* schematically shows a sheet metal part as an intermediate product in the manufacture of the exhaust-gas treatment unit in a top view.
Figure 1C:
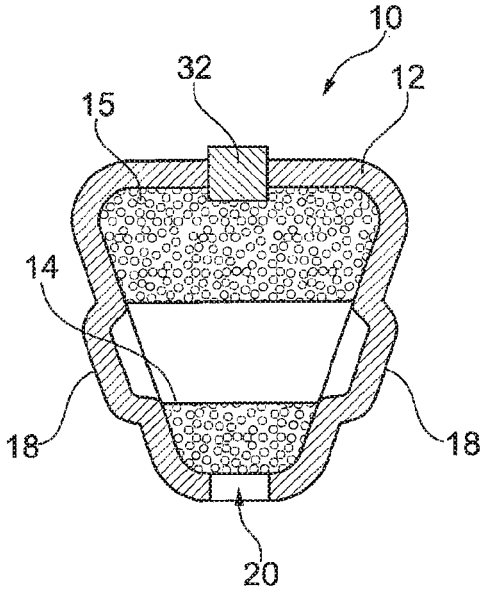
Figure 1B:
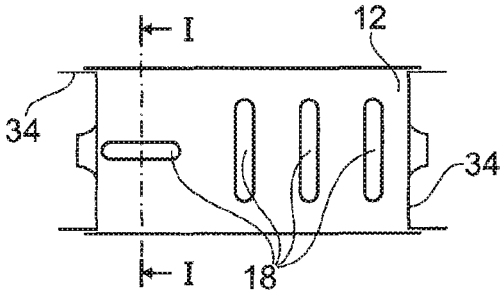

FIGS. 1*a*-1*b* and 1*c* show an exhaust-gas treatment unit 10 in a lateral view and in section, respectively.

The exhaust-gas treatment unit 10 is intended for vehicles and may for example be a muffler, a catalyst, and/or a particulate filter.

The exhaust-gas treatment unit 10 has a housing 12 in which inserts 14, for example for sound damping, may be arranged.

Sound-damping material 15, wool for example, can furthermore be provided within the housing 12.

The housing 12 is made of a sheet metal part 16 having embossings 18.

The embossings 18 project outwardly from the housing 12. Inwardly projecting embossings are however also conceivable.

A hole 20 is furthermore provided in the housing 12, for example for fastening the housing 12 to the vehicle.

The housing 12 is cylindrical and has a substantially trapezoidal base having rounded corners in the shown embodiment.

Circular, oval, or elliptic bases are of course also conceivable.

A flat sheet metal part 16 is at first cut to size to manufacture the housing 12.

The sheet metal part 16 has a wall thickness of less than 1.25 mm, in particular of 0.8 or less such that the housing 12 also has a wall thickness of less than 1.25 mm, in particular of 0.8 mm or less.

Figure 2A:
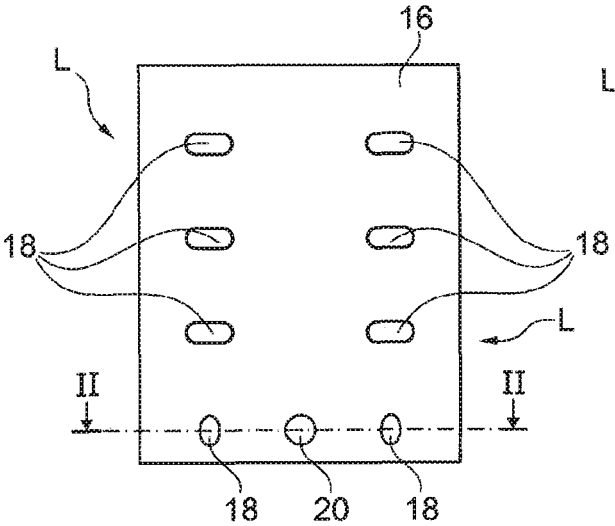
FIG. 2*b* shows the sheet metal part according to FIG. 2*a* in a schematic sectional view along the axis II-II, FIG. 3 schematically shows the sheet metal part of FIG. 2*b* during round bending in section.

The sheet metal part 16 is then provided with the embossings 18. The hole 20 is also formed. Such a sheet metal part 16 is illustrated in FIGS. 2*a* and 2*b*.

The cutting to size of the sheet metal part 16 and the incorporation of the embossings 18 and of the hole 20 can be carried out in one common processing step. They are, for example, both realized in a stamping tool (not shown). The sheet metal part 16 can be cut to size using the stamping tool, and the embossings 18 can be incorporated in the same stroke.

The embossings 18 are ribs or beads which are incorporated into the faces of the sheet metal part 16 forming the walls of the housing 12.

Figure 2B:
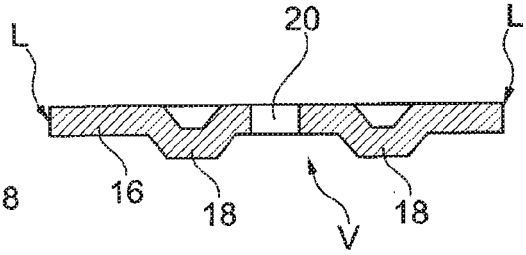

In the embodiment shown in FIG. 2*b*, the hole 20 is, for example, surrounded by two embossings 18 extending perpendicularly to the section plane.

All embossings 18 are incorporated into the sheet metal part 16 to project to the same side of the sheet metal part 16 which is referred to as projecting side V below.

The embossed sheet metal part 16 is reshaped using a round bending tool 22.

Figure 3:
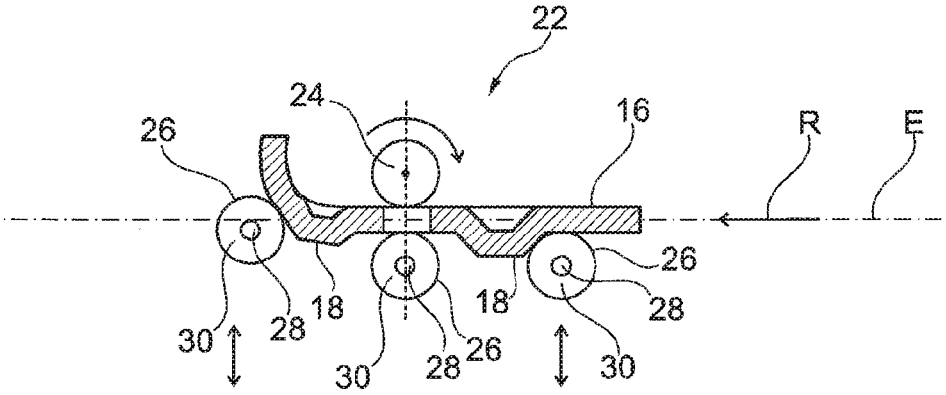

A round bending tool 22 is schematically illustrated in FIG. 3 by way of example.

The round bending tool 22 includes an upper roll 24 and three lower rolls 26.

Among the upper roll 24 and the lower rolls 26, at least one roll is driven to be able to displace the inserted and already embossed sheet metal part 16.

Only the upper roll 24 is driven in the embodiment shown.

The three lower rolls 26 are configured as elastic rolls. This means that their peripheral wall is elastically flexible.

To this end, the lower rolls 26 include a widely rigid roll core 28 and an elastic coating 30 along its entire periphery, for example a rubber coating.

The coating 30 can be vulcanized onto the roll core 28. Furthermore, it may have a thickness of at least about 5 mm and/or a maximum Shore hardness of 95.

The upper roll 24 and the roll cores 28 of the lower rolls 26 are made of steel.

In the rest position of the round bending tool, the three lower rolls 26 are arranged side by side and parallel to each other, their peripheral walls forming an even supporting surface which defines an introduction plane E.

The roll axes of the upper rolls 24 and of the lower rolls 26 are parallel to each other and parallel to the introduction plane E.

The central lower roll of the three lower rolls 26 has a space-fixed central axis, whereas the two outer lower rolls 26 are adapted to be shifted in a motorized manner perpendicularly to the introduction plane E. The two outer lower rolls 26 are thus mounted so as to be shiftable with respect to each other in the direction of the perpendicular arrows in FIG. 3.

The upper roll 24 is arranged on the opposite side of the introduction plane E of the lower rolls 26. More precisely, a straight line through the axes of the upper roll 24 and the central lower roll 26 forms a perpendicular to the introduction plane E.

For round bending the sheet metal part 16, the sheet metal part 16 is introduced into the round bending tool 22 in the introduction plane E. It must be pointed out here that the projecting side V of the embossings 18 is arranged on the side of the introduction plane E which faces the lower rolls 26 such that the lower rolls 26 which are configured as elastic rolls come into contact with the projecting side V of the embossings 18.

The sheet metal part 16 is introduced between the upper roll 24 and the central lower roll 26 and can be displaced back and forth along the displacement direction R by the driven roll which is the upper roll 24 in the present case.

In order to reshape the sheet metal part 16, one of the outer lower rolls 26 is pushed forward and displaced into the introduction plane E, whereas the sheet metal part 16 is displaced several times back and forth by the driven upper roll 24. The sheet metal part 16 is thus deviated and bent by the advanced lower roll 26.

The bending angle or the local bending radius is determined by the distance between the upper roll 24 and the advanced lower roll 26.

A snapshot of such a round bending process is illustrated in FIG. 3.

Figure 4A:
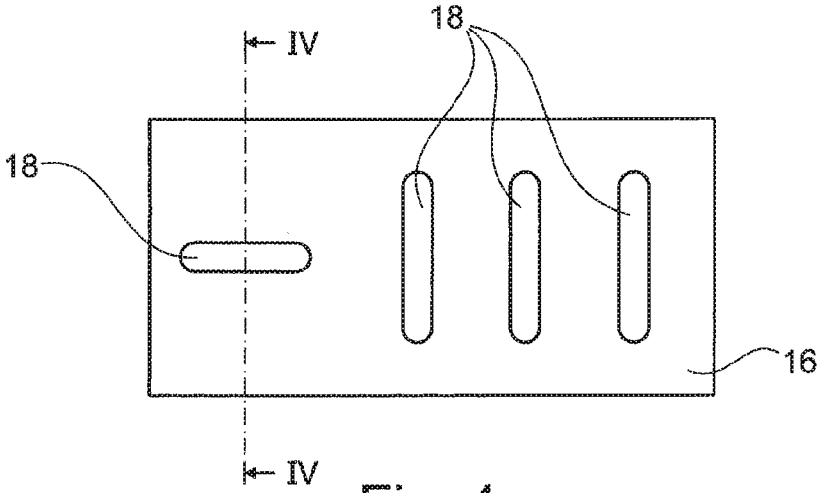
FIG. 4*a* shows the sheet metal part according to FIG. 2*a* after round bending in a lateral view.
Figure 4B:
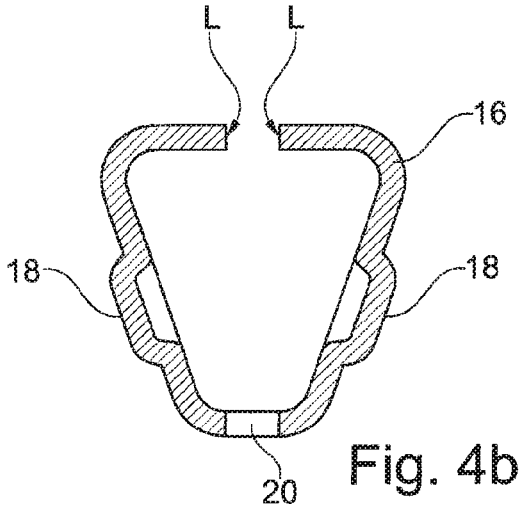
FIG. 4*b* shows the sheet metal part according to FIG. 4*a* in a section along the axis Iv-Iv of FIG. 4*a*.

The sheet metal part 16 is brought into a cylindrical shape by round bending as illustrated in FIGS. 4*a* and 4*b*, for example.

The longitudinal direction of this cylindrical shape of the sheet metal part 16 is parallel to the roll axes of the upper roll 24 and the lower rolls 26.

The projecting side V of the embossings 18 only comes into contact with elastic rolls, and the elastic coating 30 of the elastic rolls, in the present case the rubber coating of the lower rolls 26, adjusts to the shape of the embossings 18. The embossings 18 are thus also maintained during round bending.

In the embodiment shown, the sheet metal part 16 is reshaped such that the incorporated ribs are arranged on the lateral walls of the cylindrical sheet metal part.

The longitudinal edges L of the sheet metal part 16 are now arranged opposite each other. It is also conceivable that they slightly overlap each other. A cylinder having a closed or slightly open cross-section is obtained. The longitudinal edges L can however also be brought into contact with each other without any further plastic reshaping.

In the next step, the longitudinal edges L of the sheet metal part 16 are connected to each other. This can be carried out by welding, in particular tungsten inert-gas welding (TIG welding).

Figure 5:
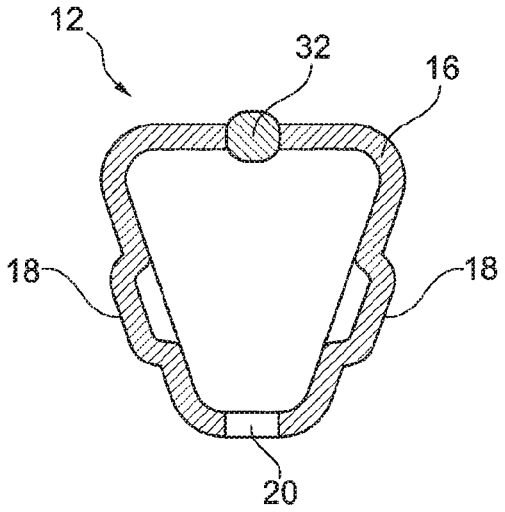
FIG. 5 shows a housing manufactured in accordance with the method in section, FIG. 6 schematically shows the housing of FIG. 5 in a lateral view along with a sound-damping insert to be inserted and sound-damping material.

FIG. 5 illustrates the finished housing 12 with the longitudinal edges L of the sheet metal part 16 connected by a weld seam 32.

It is however also conceivable that the two longitudinal edges L of the sheet metal part 16 are connected by seaming.

The housing 12 is now circumferentially closed and can be used for the manufacture of an exhaust-gas treatment unit 10.

Figure 6:
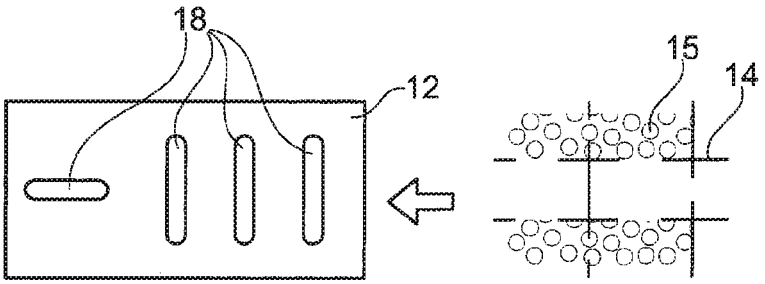

An insert having, for example, walls and sound-damping material 15 is inserted into the now tubular housing 12. The insertion of the insert 14 is realized by stuffing. This process is indicated in FIG. 6.

It is also conceivable that the insert 14 is a monolith of a catalyst or of a particulate filter.

Covers 34 are then mounted to the end faces of the housing 12 as a result of which the exhaust-gas treatment unit 10 as illustrated in FIGS. 1*a* and 1*b* is finished.

As can be seen in FIG. 1*a*, the covers 34 can be mounted radially to the outside of the housing 12.

FIG. 1*b* shows an embodiment in which the covers 34 are fastened radially inside to the housing 12.

Figure 7:
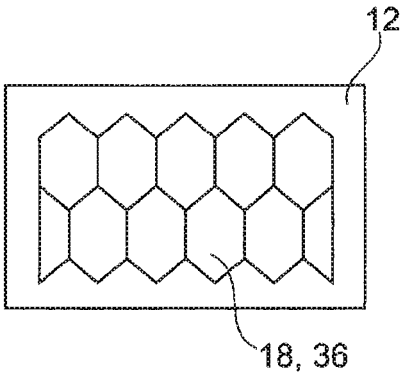
FIG. 7 shows a second embodiment of a housing manufactured according to the invention in a lateral view.

FIG. 7 illustrates a second embodiment of a housing 12 in a lateral view. This substantially corresponds to the first embodiment, also in terms of its manufacture, and identical parts or parts having an identical function are provided with the same reference numbers. Merely the differences are explained below which are composed of the differences relating to the embossing.

In the housing 12 of the second embodiment, the embossings 18 are not ribs but produce a honeycomb structure 36 as a result of which a particular stability is conveyed to the housing.

This honeycomb structure 36 is of course adapted to be combined with any features of the first embodiment, also with other embossings which in turn can be configured as a rib or a bead.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A method of manufacturing a cylindrical housing of an exhaust-gas treatment unit for vehicles, comprising the steps of:

a) providing a flat sheet metal part that is flat and has at least one embossing;

b) round bending the sheet metal part in a round bending tool by displacing the sheet metal part between rolls such that the sheet metal part obtains a cylindrical shape having a longitudinal direction parallel to roll axes of the rolls, and with at least one elastic roll being used such that the at least one embossing of the sheet metal part is maintained during round bending, and wherein a projection side of the at least one embossing only comes into contact with the at least one elastic roll; and c) connecting longitudinal edges of the sheet metal part to form a tube.

2. The method according to claim 1, wherein the sheet metal part is cut to size and embossed prior to round bending.

3. The method according to claim 2, wherein the cutting to size and the embossing are carried out in one processing step.

4. The method according to claim 3, wherein the cutting to size and the embossing are carried out in a stamping tool, the cutting to size of the sheet metal part and the incorporation of the embossing being carried out in the same stroke.

5. The method according to claim 1, wherein a rib, a bead, and/or a honeycomb structure is produced by the embossing.

6. The method according to claim 1, wherein the at least one embossing comprises a plurality of embossings that are incorporated into the sheet metal part, all embossings projecting to a common side comprising the projection side of the sheet metal part, and the at least one elastic roll which comes into contact with the projection side of the plurality of embossings being realized as having an elastic coating.

7. The method according to claim 1, wherein the rolls include lower rolls that are arranged side by side and parallel to each other, and with outer lower rolls in the displacement direction of the sheet metal part being shifted with respect to each other when the sheet metal part is displaced.

8. The method according to claim 1, wherein the at least one elastic roll has a roll core and an elastic coating, the elastic coating being fastened onto the roll core.

9. The method according to claim 8, wherein the elastic coating has a thickness of at least about 5 mm and/or a maximum Shore hardness of 95 is used.

10. The method according to claim 8, wherein the elastic coating is a rubber coating that is vulcanized onto the roll core.

11. The method according to claim 1, wherein roll cores and/or rolls made of steel are used when the rolls are not elastic rolls.

12. The method according to claim 1, wherein the cylindrical housing has a wall thickness of less than 1.25 mm.

13. The method according to claim 1, wherein the longitudinal edges are connected to each other by welding and/or by seaming.

14. A method of manufacturing a cylindrical housing of an exhaust-gas treatment unit for vehicles, comprising the steps of:

a) providing a sheet metal part that is flat and has at least one embossing;

b) round bending the sheet metal part in a round bending tool by displacing the sheet metal part between rolls such that the sheet metal part obtains a cylindrical shape having a longitudinal direction parallel to roll axes of the rolls, and with at least one elastic roll being used such that the at least one embossing of the sheet metal part is maintained during round bending, and wherein the rolls comprise at least three rolls that are used for the round bending, the at least three rolls including at least one upper roll and one lower roll, with at least one roll being driven, and the sheet metal part being displaced several times back and forth between the rolls, and the at least one upper roll and the at least one lower roll being spaced from each other in different manners in the individual displacement steps; and c) connecting longitudinal edges of the sheet metal part to form a tube.

15. A method of manufacturing an exhaust-gas treatment unit for vehicles, comprising the steps of:

manufacturing a cylindrical housing by providing a sheet metal part that is flat and has at least one embossing;

round bending the sheet metal part in a round bending tool by displacing the sheet metal part between rolls such that the sheet metal part obtains a cylindrical shape having a longitudinal direction parallel to roll axes of the rolls, and with at least one elastic roll being used such that the at least one embossing of the sheet metal part is maintained during round bending, and wherein a projection side of the at least one embossing only comes into contact with the at least one elastic roll; and connecting longitudinal edges of the sheet metal part to form a tube;

inserting an insert into the cylindrical housing which is circumferentially closed; and fastening covers to end faces of the cylindrical housing.

16. The method according to claim 15, wherein sound-damping material is incorporated into the cylindrical housing.

17. The method according to claim 16, wherein the sound-damping material is wool.

* * * * *